US008578560B1

(12) United States Patent
Swinehart et al.

(10) Patent No.: US 8,578,560 B1
(45) Date of Patent: Nov. 12, 2013

(54) LOCKING HINGE WITH BUTTON RELEASE

(75) Inventors: James P. Swinehart, Fitchburg, WI (US); Steven R. Witherspoon, Oregon, WI (US)

(73) Assignee: Metalcraft Industries, Inc., Oregon, WI (US)

( * ) Notice: Subject to any disclaimer, the term of this patent is extended or adjusted under 35 U.S.C. 154(b) by 28 days.

(21) Appl. No.: 13/234,367

(22) Filed: Sep. 16, 2011

Related U.S. Application Data

(60) Provisional application No. 61/428,612, filed on Dec. 30, 2010.

(51) Int. Cl.
*E05D 11/10* (2006.01)

(52) U.S. Cl.
USPC ..... 16/324; 16/326

(58) Field of Classification Search
USPC ..... 16/324, 326–328, 352, 353, 320, 321, 16/331, 335, 349, 371; 403/93, 94, 96, 97, 403/103, 104; 297/16.1, 183.2, 183.3, 297/183.4, 354.12, 354.13, 363, 364, 369, 297/376, 378.12, 398, 400, 411.35, 411.38, 297/411.39
See application file for complete search history.

(56) References Cited

U.S. PATENT DOCUMENTS 2,083,140 A * 6/1937 Brantingson ..... 16/334
2,427,384 A * 9/1947 Bushko ..... 16/325
2,578,153 A * 12/1951 Schmitz ..... 4/236
3,157,433 A * 11/1964 Davis ..... 297/378.12
3,629,900 A * 12/1971 Beerli, Jr. ..... 16/349
3,704,910 A 12/1972 Willcott
3,744,085 A * 7/1973 Griego ..... 16/325
3,769,928 A * 11/1973 Kahl ..... 114/221 R
3,874,029 A * 4/1975 McCullough ..... 16/329
4,073,537 A 2/1978 Hammersburg
5,168,601 A * 12/1992 Liu ..... 16/445
5,209,215 A * 5/1993 Morrison ..... 124/25
5,267,357 A * 12/1993 Ades ..... 4/253
5,362,082 A 11/1994 Kornberg
5,564,788 A 10/1996 Warhaftig
5,669,668 A * 9/1997 Leuchtmann ..... 297/408
5,678,798 A 10/1997 Little (Continued)

FOREIGN PATENT DOCUMENTS

DE 19859305 A1 * 6/2000
EP 1584315 10/2005
FR 2401355 A * 4/1979
FR 2564517 A1 * 11/1985

*Primary Examiner* — Chuck Mah
(74) *Attorney, Agent, or Firm* — Charles S. Sara, Esq.; DeWitt Ross & Stevens, S.C.

(57) ABSTRACT

A seat positioning device includes a swingable support pad secured to a hinge, which is secured to a wheelchair seat back via a hardware assembly. The hinge includes a frame bracket with primary and secondary flanges having a rotatable barrel secured therebetween. A lock plate locking flange, sized to be receivable within a barrel locking groove formed in one end of the barrel, is spring-biased into a locking aperture in the secondary flange and toward the barrel locking groove. The barrel can rotate until the locking flange, locking aperture, and locking groove are aligned and the locking flange is allowed to lock the hinge in position by entering the locking groove through the locking aperture. The hardware assembly is configured to position the hinge so as to minimize the extent to which the pad extends beyond the side of a wheelchair when the pad is in a stowed position.

22 Claims, 5 Drawing Sheets

(56) References Cited

U.S. PATENT DOCUMENTS

| | | | | |
|---|---|---|---|---|
| 6,032,975 | A | 3/2000 | Hanson et al. | |
| 6,257,664 | B1 | 7/2001 | Chew et al. | |
| 6,305,749 | B1 * | 10/2001 | O'Connor et al. | 297/397 |
| 6,343,406 | B1 * | 2/2002 | Yeh | 16/328 |
| 6,361,118 | B1 | 3/2002 | Melgarejo et al. | |
| 6,460,927 | B1 | 10/2002 | Groth | |
| 6,460,933 | B1 | 10/2002 | Bors et al. | |
| 6,840,577 | B2 | 1/2005 | Watkins | |
| 6,983,988 | B1 | 1/2006 | Lo | |
| 7,891,056 | B2 * | 2/2011 | McAfee | 16/374 |
| 2005/0206214 | A1 | 9/2005 | Kosh et al. | |
| 2006/0091706 | A1 | 5/2006 | Christofferson et al. | |
| 2006/0192362 | A1 | 8/2006 | Makhsous et al. | |

* cited by examiner

LOCKING HINGE WITH BUTTON RELEASE

CROSS-REFERENCE TO RELATED APPLICATIONS

This application claims priority under 35 USC §119(e) to U.S. Provisional Patent Application 61/428,612 filed Dec. 30, 2010, the entirety of which is incorporated by reference herein.

FIELD OF THE INVENTION

This document concerns an invention relating generally to locking and swinging hinge mechanisms, and more specifically to locking and swinging hinge mechanisms well suited for use in medical settings, such as for positioning lateral thoracic pads to the seat backs of wheelchairs.

BACKGROUND OF THE INVENTION

Wheelchairs are often provided with lateral thoracic pads to support the sides of occupants/patients seated in the wheelchairs. It is difficult, however, for a user to enter and exit the wheelchair when a pair of support pads is positioned to support the user's sides when seated. Accordingly, support pads preferably are able to swing out to allow patients to better clear the support pads when entering or exiting the wheelchair. This functionality is generally achieved by securing the support pad to a hinge mechanism. The hinge mechanism is generally secured to the seat back of the wheelchair using a suitable hardware assembly, and allows the pad to swing into position to support the patient, and out of the way to allow the patient to enter and exit the wheelchair.

Prior devices include hinges attached via brackets to the seat back of a wheelchair. Some devices, such as the one disclosed by U.S. Pat. No. 5,362,082, have a hinge device attached to the back of a wheelchair by a bracket. Such hinges are considered "side opening" because they are placed at or near the sides of the wheelchair back. This is a disadvantage in the wheelchair industry, particularly when the back of the wheelchair needs to be adjusted to be placed between the push rods of the wheelchair, as is often the case when the wheelchair occupant needs to be moved. The side opening hinges block movement of the wheelchair back. Also, prior art hinges tend not to be sufficiently strong and durable to withstand the rigors of medical use. What is needed is a versatile hinge mechanism that is strong and compact.

SUMMARY OF THE INVENTION

The invention, which is defined by the claims set forth at the end of this document, is directed to hinge mechanisms well suited for medical settings which at least partially alleviate the aforementioned problems. A basic understanding of some of the features of preferred versions of the invention can be attained from a review of the following brief summary of the invention, with more details being provided elsewhere in this document. To assist in the reader's understanding, the following review makes reference to the accompanying drawings (which are briefly reviewed in the "Brief Description of the Drawings" section following this Summary section of this document).

Referring initially to FIGS. 1, 2A, and 2B, an exemplary seat positioning device includes a hinge mechanism 12 secured to an interface bracket 25 and a pad bracket 24. The interface bracket 25 is part of a hardware assembly 250 used to secure the hinge mechanism 12 to, for example, a seat back

200 of a wheelchair. The pad bracket 24 is securable to, for example, a lateral thoracic pad 305 for supporting an occupant of the wheelchair. The hinge mechanism 12 permits the pad bracket 24 (and thus the pad 305) to swivel between a stowed position and an engaged position. In the stowed position, shown on the left side of FIG. 1, the pad 305 is "swung away" to permit the occupant to enter and exit the wheelchair. In the engaged position, shown on the right side of FIG. 1, the pad 305 extends out from the seat back 200 (making, for example, an approximately 90-degree angle with the seat back 200) to support the occupant's sides.

Referring to FIGS. 3A-D, the hinge mechanism 12 includes a frame bracket 1 defining a primary valley 55 and a smaller secondary valley 57, as discussed below. A barrel 2 extends from a barrel first end 2A (the top end of the barrel 2) to a barrel second end 2B (the bottom end of the barrel 2). Barrel locking grooves 116, 118 are shown as indentations at the top and bottom ends 2A, 2B of the barrel 2. The barrel 2 is positioned in the primary valley 55 and is rotatable about a barrel long axis. A lock plate 5 includes a locking flange 122 extending from a lock plate base 120, with the lock plate base 120 positioned in the secondary valley 57 of the frame bracket 1. The locking flange 122 is sized to be receivable within the barrel locking grooves 116, 118. When the locking flange 122 is not positioned in one of the barrel locking grooves 116, 118, the barrel 2 is in a rotatable state and is thus rotatable about the barrel long axis. The pad 305 is able to transition between stowed and engaged positions when the hinge mechanism 12 is in the rotatable state. When the locking flange 122 is positioned in one of the barrel locking grooves 116, 118, the barrel 2 is prohibited from rotating and is thus in a locked state. The hinge mechanism 12 is preferably in the locked state when the pad 305 is an engaged position.

The hinge mechanism 12, hardware assembly, and other components are further discussed below. The compact locking hinge mechanism 12 is strong, versatile, durable, and easy to use. It is reliable enough to withstand the day-to-day riggers experienced by medical hardware. Further advantages and features of the invention will be apparent from the remainder of this document in conjunction with the associated drawings.

BRIEF DESCRIPTION OF THE DRAWINGS

In FIG. 3B, the hinge mechanism 12 is in the button down, unlocked position, and in FIGS. 3C and 3D, the hinge mechanism 12 is in the button up, locked position.

DETAILED DESCRIPTION OF PREFERRED VERSIONS OF THE INVENTION

Figure 1:
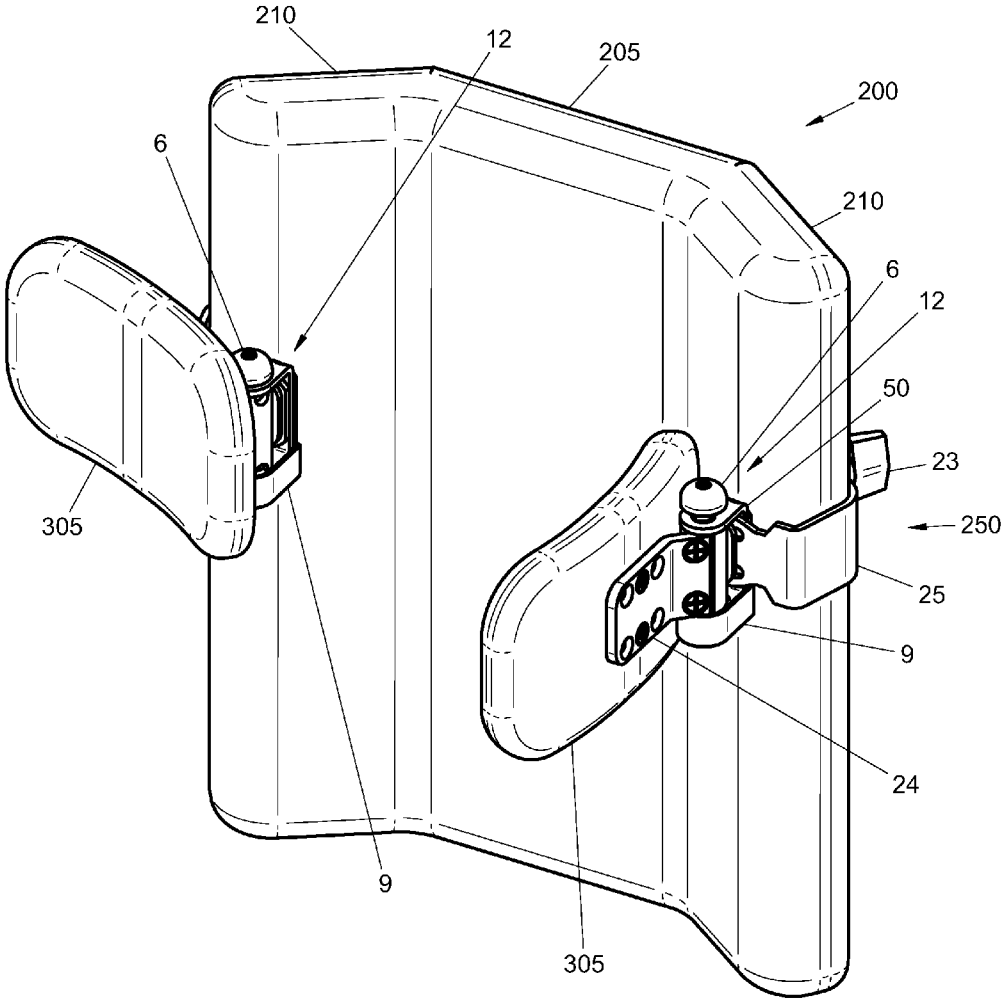
FIG. 1 is a perspective view showing a modular back 200 (of, for example, a wheelchair). A hinge mechanism 12 is secured to the modular back 200 via a hardware assembly 250 that includes interface bracket 25 (see also FIGS. 2A and 2B). A lateral thoracic pad 305 is also secured to the hinge mechanism 12 via a pad bracket 24.

Returning to FIG. 1, when the hinge mechanism 12 is used for wheelchair seat positioning, the mechanism 12 is secured to a wheelchair seat back 200 via a suitable hardware assembly. The seat back 200 shown in FIG. 1 is a modular seat back, and the hinge mechanism 12 is thus secured to the seat back 200 via a modular back hardware assembly (see FIGS. 2A and 2B). The modular seat back 200 includes seat back wings 210 extending from a seat back base 205. The interface bracket 25, which is one of the components of the hardware assembly, is secured to a seat back wing 210. When the lateral thoracic pad 305 is engaged (and the hinge mechanism 12 locked from rotating, as further discussed below), the pad 305 may make, for example, an approximately 90-degree angle with the seat back base 205. When the pad 305 is stowed, the pad 305 may be, for example, approximately parallel with the seat back wing 210 to which the hardware assembly is secured. Because the interface bracket 25 preferably positions the hinge mechanism 12 and the pad 305 inward from the edge of the seat back 200, the device is compact, such that the pad 305 does not extend substantially beyond the side of the wheelchair (beyond the wheels of the wheelchair) when the pad 305 is stowed. That is, the interface bracket 25 serves to offset the hinge mechanism 12 inward from the edge of the seat back 200.

Figures 2A, 2B:
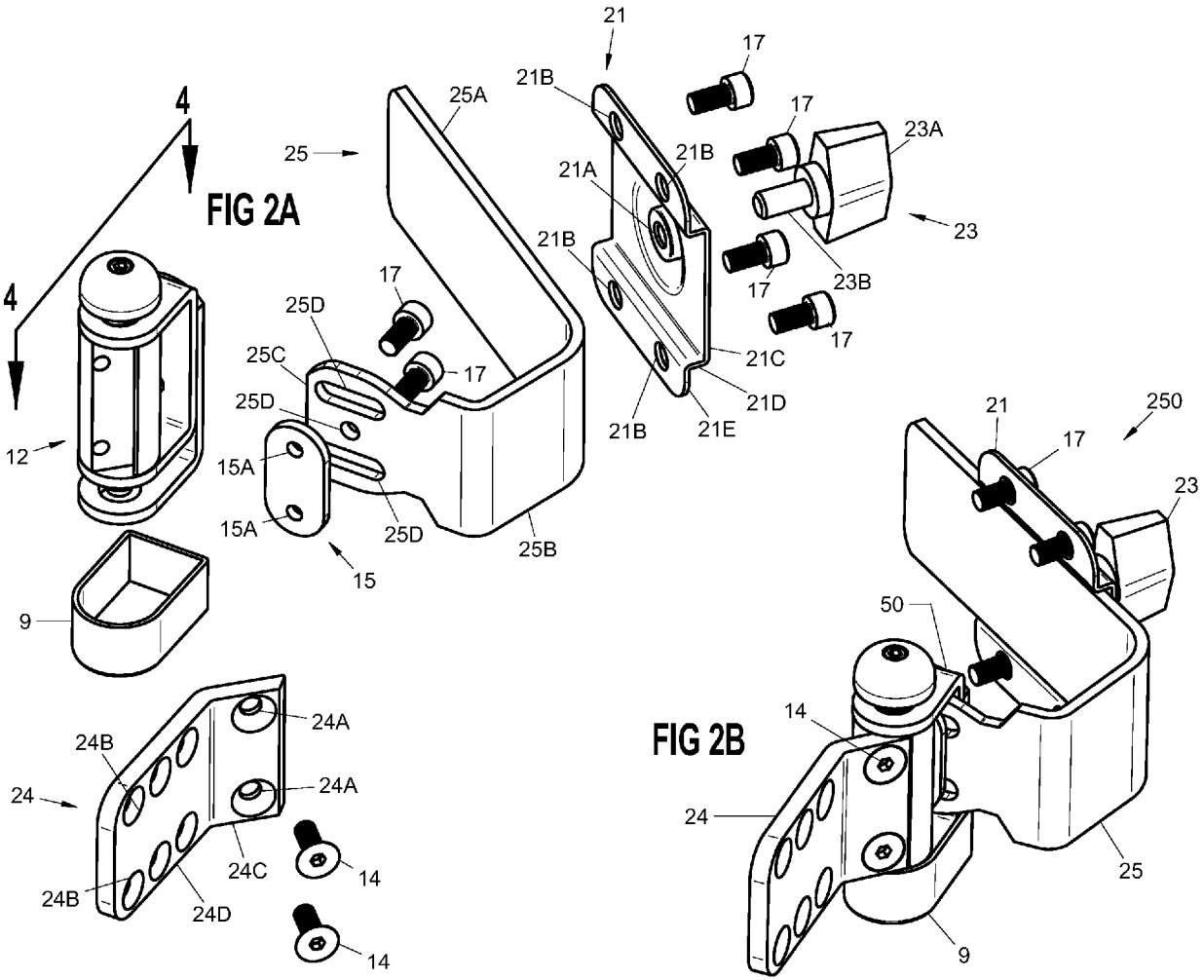
FIG. 2A is an exploded view of the hardware assembly of FIG. 1, along with the pad bracket 24 and hinge mechanism 12 of FIG. 1.
FIG. 2B is an assembled view of the components shown in FIG. 2A.

Referring to FIGS. 2A and 2B, the interface bracket 25 includes an interface bracket rear flange 25A and an interface bracket front flange 25C, the interface bracket rear and front flanges 25A, 25C extending from an interface bracket base 25B. The angles made by the rear and front flanges 25A, 25C with the base 25B are configured to accommodate the modular seat back 200 shown in FIG. 1. The interface bracket rear flange 25A interfaces with slide bracket 21. The slide bracket 21 includes slide bracket extensions 21D extending from a slide bracket base 21C, and slide bracket wings 21E extending from the slide bracket extensions 21D. The slide bracket extensions preferably have a depth that is at least as large as the thickness of the interface bracket rear flange 25A so that when the slide bracket base 21C contacts the interface bracket rear flange 25A, the slide bracket wings 21E contact the rear side of the seat back 200. The slide bracket wings 21E include slide bracket wing apertures 21B to accommodate threaded fasteners 17, which engage the seat back 200 from the rear and help secure the slide bracket 21 to the seat back 200. The slide bracket base 21C includes a slide bracket central aperture 21A to accommodate a knob 23, which includes a knob point 23B extending from a knob base 23A. Knob 23 can be screwed through the slide bracket central aperture 21A, pressing knob point 23B against the interface bracket rear flange 25A, and helping secure the interface bracket 25 to the seat back 200.

Figure 3B:
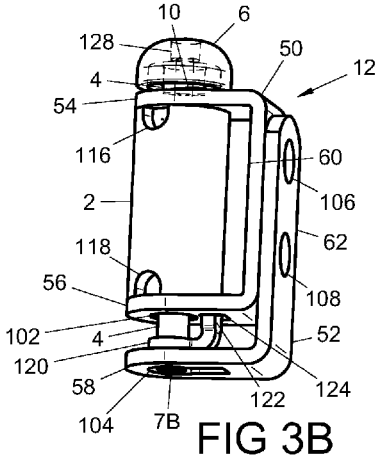
FIGS. 3B-3D show the hinge mechanism 12 of FIG. 3A (excluding the cover 9) in assembled form from three different perspectives.
Figure 3D:
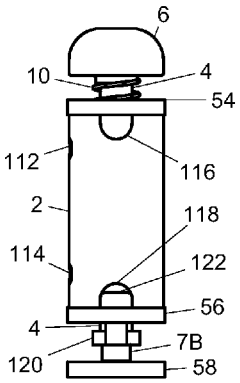
Figure 3C:
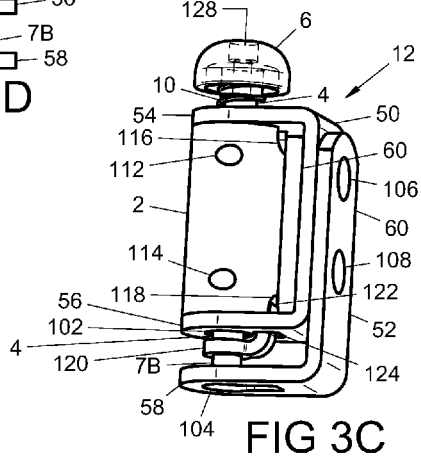
Figure 3A:
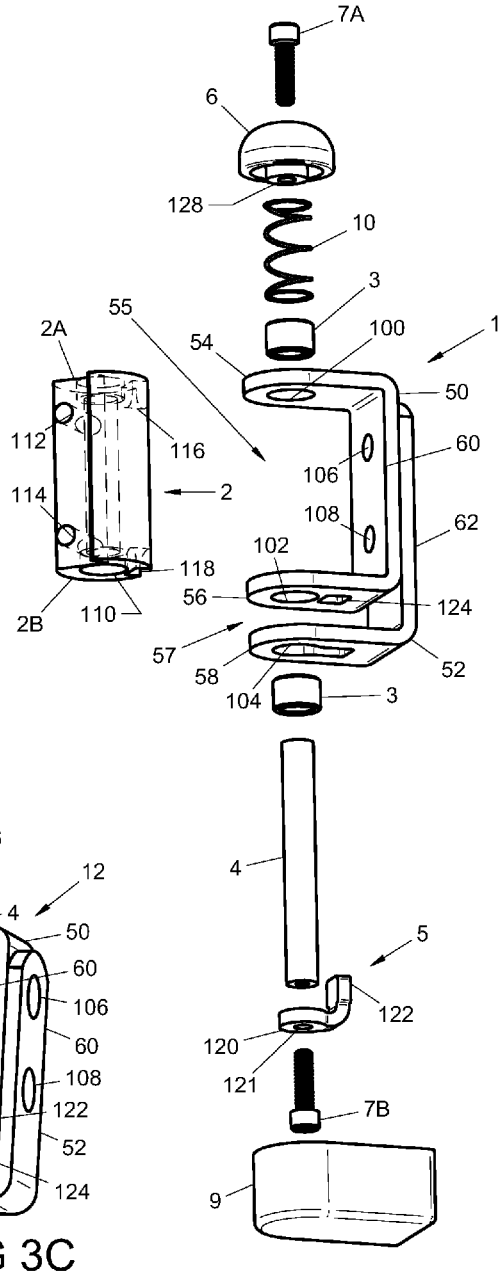
FIG. 3A is an exploded view of the hinge mechanism 12 of FIGS. 1, 2A, and 2B.
Figure 4:
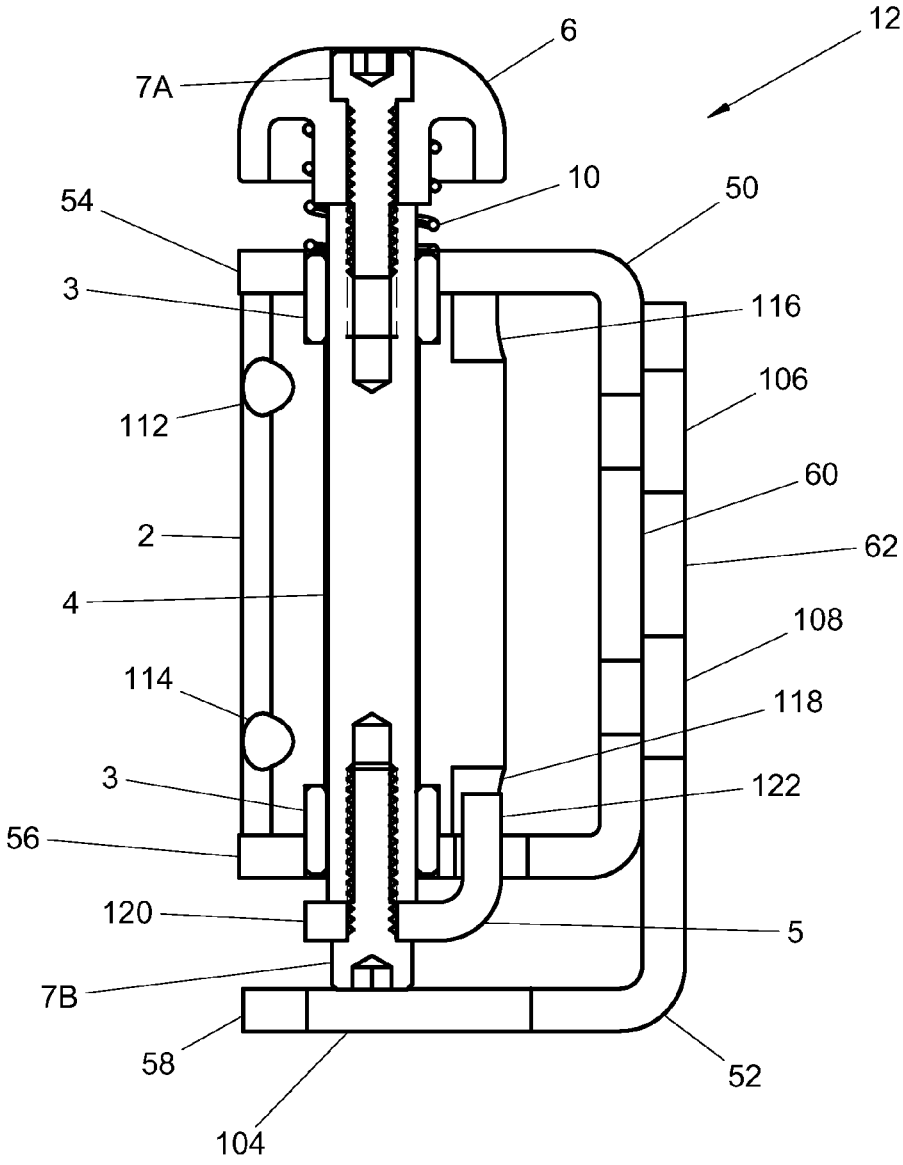
FIG. 4 shows a cross-sectional view (taken along lines 4-4 of FIG. 2A) of the hinge mechanism 12 of FIG. 1.

Referring to the hinge mechanism 12 shown in FIG. 3A, a frame bracket 1 (formed by a U-shaped bracket portion 50 affixed to an L-shaped bracket portion 52) includes primary, secondary, and tertiary flanges 54, 56, 58. The primary flange 54 and the secondary flange 56 extend perpendicularly from the U-shaped bracket base 60, and the tertiary flange 58 extends perpendicularly from an L-shaped bracket base 62 (with the U-shaped bracket base 60 and the L-shaped bracket base 62 forming the base of the frame bracket 1). The primary valley 55 is formed between the primary and secondary flanges 54, 56, and the secondary valley 57 is formed between the secondary and tertiary flanges 56, 58. Primary, secondary, and tertiary flange apertures 100, 102, 104 are formed in the primary, secondary, and tertiary flanges 54, 56, 58, respectively. The secondary flange 56 also includes a locking aperture 124 formed therein. The U-shaped and L-shaped bracket bases 60, 62 include upper and lower bracket base apertures 106, 108 extending therethrough.

Referring again to FIG. 2A, the interface bracket front flange 25C includes front flange apertures 25D for receiving threaded fasteners 17. The elongated shape of the front flange apertures 25D allows for adjustment of the position of the hinge mechanism 12 with respect to the interface bracket base 25B. A tapping clamp plate 15 includes tapping clamp apertures 15A for receiving threaded fasteners 17. The interface bracket front flange 25C and the tapping clamp are positioned on opposing sides of the frame bracket base (with the tapping clamp 15 contacting the U-shaped bracket base 60, and the interface bracket front flange 25C contacting the L-shaped bracket base 62). The threaded fasteners 17 can then engage front flange apertures 25D, upper and lower bracket base apertures 106, 108 (see FIG. 3A), and the tapping clamp apertures 15A to secure the interface bracket 25 to the hinge mechanism 12 (and thus secure the hinge mechanism 12 to the seat back 200).

Returning to FIG. 3A, a cylindrical barrel 2 has a height substantially equal to the spacing between the primary and secondary flanges 54, 56 of the U-shaped bracket portion 50. A barrel channel 110 extending the height of the barrel 2 is formed through the center of the barrel 2 between opposing ends thereof. Upper and lower barrel mounting apertures 112, 114 are formed in the barrel 2 between opposing sides thereof, the barrel mounting apertures 112, 114 having a long axis that is substantially perpendicular to the axis of the cylindrical barrel 2. The barrel mounting apertures 112, 114 are threaded, allowing them to receive threaded screw fasteners 14, as discussed below. The barrel 2 additionally includes upper and lower barrel locking grooves 116, 118 (with approximately semi-elliptical shapes) formed therein.

Referring also to the assembled hinge mechanism 12 in FIGS. 3B-3D and 4, the barrel 2 is placed between the flanges 54, 56 of the U-shaped bracket portion 50, with the primary flange aperture 100, barrel channel 110, and secondary flange aperture 102 aligned with each other. The two pivot bushings 3 are inserted in the primary and secondary flange apertures 100, 102, holding the barrel 2 in place while leaving the barrel 2 axially rotatable about its long axis. The actuation rod 4, which has a height greater than the spacing between the primary and secondary flanges 54, 56 and which is internally threaded at each end to receive a threaded rod fastener 7A, 7B, is inserted through the apertures in the pivot bushings 3 and the barrel channel 110. The actuation rod 4 is also inserted through a cylindrical compression spring 10. A button 6, having a threaded button aperture 128 extending therethrough, is secured to the actuation rod 4 by inserting the rod fastener 7A through the button aperture 128 and screwing the rod fastener 7A into the actuation rod 4. Screwing the rod fastener 7A into the actuation rod 4 compresses the spring 10 between the button 6 and the bushing 3 situated within the primary aperture 100, spring biasing the button 6 away from the primary flange 54.

The lock plate 5, having a general L-shape, includes locking flange 122 extending from lock plate base 120, the lock plate base 120 having a lock plate base aperture 121 formed therein. The locking flange 122 is configured to be complementarily receivable through the locking aperture 124 and into the barrel locking grooves 116, 118 (as assembled in the drawings, the locking flange 122 is receivable in locking groove 118). The lock plate 5 is inserted in the secondary valley 57 of the frame bracket 1 as defined by the secondary and tertiary flanges 56, 58. Once the lock plate 5 is positioned between the secondary and tertiary flanges 56, 58, a locking fastener 7B is inserted (from below the tertiary flange 58) through the tertiary flange aperture 104 and the lock plate base aperture 121, and into the actuation rod 4 (through the end of the actuation rod 4 opposing the end of the actuation rod 4 in which the rod fastener 7A is inserted).

Once the rod fastener 7B is screwed into the actuation rod 4 (and the barrel 2 is secured to the frame bracket 1), a portion of the locking flange 122 is positioned in locking aperture 124 of the secondary flange 56, fixing the angle of the lock plate 5 with respect to the secondary flange 56 (and prohibiting it from rotating with respect thereto). That is, the lock plate 5 does not rotate with respect to the frame bracket 1 as the barrel 2 is rotated with respect to the frame bracket 1. The barrel 2 within an assembled hinge mechanism 12 can rotate about its long axis when button 6 is sufficiently pressed down, further compressing the spring 10 and bringing the button 6 closer to the primary flange 54 (spring 10 biases the button 6 away from the primary flange 54). When the actuation rod 4 (and thus the lock plate 5) is sufficiently pushed down (by sufficiently pressing down on button 6), the locking flange 122 can exit the locking groove 118. When the button 6 is pressed, the lock plate 5 can descend until the button 6 comes in contact with the primary flange 54. The locking flange 122 is prevented from retracting from the locking aperture 124 because the height of the lock plate 5 is preferably at least as great as the maximum distance traveled by the button 6 when pressed downwards from its unpressed state.

With the locking flange 122 disengaged from the locking groove 118, the barrel 2 is free to rotate about its long axis. Button 6 remains in a "down" position (even with no force being applied on button 6 in the direction of the primary flange) and barrel 2 remains rotatable as long as the locking flange 122 cannot enter locking groove 118. The lock plate 5 tends to move (upward) in the direction of the primary flange 54 because of the spring-biasing provided by the spring 10, but the locking flange 122 abuts the barrel 2 and prevents the actuation rod 4 from retracting upward farther away from the tertiary flange 58 (prohibiting the button 6 from returning to its "up" position). While locking aperture 124 is out of alignment with the barrel locking groove 118 (and the locking flange 122 is thus abutting the barrel 2, unable to enter the barrel locking groove 118), the button remains "down" and the barrel 2 is rotatable. The button 6 can return to its "up" position to lock the hinge mechanism 12 into position when flange 122, locking aperture 124, and locking groove 118 are aligned. That is, the barrel 2 will only rotate until the locking flange 122 is aligned with the barrel locking groove 118 (or the barrel 2 locking groove 116 if the barrel 2 is inserted into the frame bracket 1 in an inverted orientation). Once the locking flange 122 of the lock plate 5 is aligned with the barrel locking groove 118, the locking flange 122 enters the barrel locking groove 118, locking the barrel 2 in position and preventing it from rotating about its axis (until the button 6 is again pressed to retract the locking flange 122 from the barrel locking groove 118).

A cover 9 can be placed over the space between secondary and tertiary flanges 56, 58 by fitting over the tertiary flange 58 and a portion of the L-shaped bracket base 62. The cover 9 can be used to protect against dirt and unwanted objects that could otherwise enter the space between the secondary and tertiary flanges 56, 58 and interfere with the locking mechanism. The cover 9 also enhances safety by preventing fingers or other objects from becoming pinched or trapped between the lock plate 5 and the secondary flange 56.

Figure 2C:
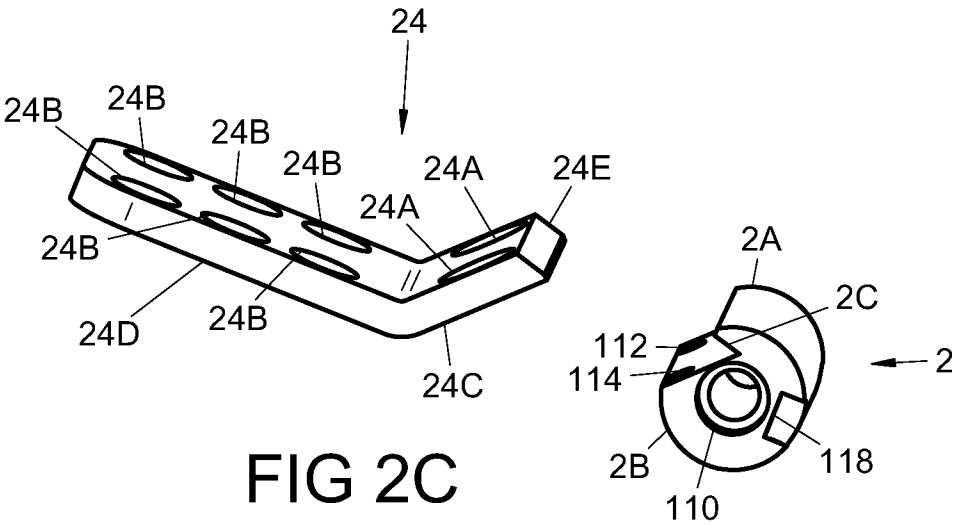
FIG. 2C is an exploded view of the pad bracket 24 and the barrel 2, showing surfaces 24E and 2C having a complementary mating angle.

Returning to FIG. 2B, the lateral thoracic pad 305 can be secured to the hinge mechanism 12 via the pad bracket 24. The pad bracket 24 includes a pad bracket flange 24D (which includes pad bracket flange apertures 24B formed therein) extending from a pad bracket base 24C (which includes pad bracket base apertures 24A formed therein). The pad bracket 24 is securable to the barrel 2 using fasteners 14, which engage barrel mounting apertures 112, 114 through pad bracket base apertures 24A. As shown in FIG. 2C, the pad bracket base 24C terminates in a base end surface 24E, and the base end surface 24E may be angled with respect to the front and back surfaces of the pad bracket base 24C. Also, the barrel 2 may include an angled barrel surface 2C cut therein. Preferably, the base end surface 24E and the barrel surface 2C may be complementarily angled with each other such that the two surfaces 24E, 2C mate when the pad bracket 24 and the barrel 2 are brought together. This strengthening feature is due to the barrel 2 complementarily receiving and "trapping" the base end surface 24E when the barrel 2 is secured to the pad bracket 24. Referring again to FIGS. 1 and 2B, the lateral thoracic pad 305 is securable to the pad bracket 24 using another pair of screw fasteners 14, which engage a pair of pad apertures (not pictured) formed in the lateral thoracic pad 305 via two of the pad bracket flange apertures 24B. The relative position of the pad 305 with respect to the pad bracket 24 is further adjustable depending on which pair of pad bracket flange apertures 24B is selected. The angle between the pad bracket flange 24D and the pad bracket base 24C is configured such that the pad 305 is appropriately positioned for supporting the side of the patient.

It should be understood that various terms referring to orientation and position are used throughout this document—for example, "down" (as in "pressing down on button 6"), "below" (as in "from below the tertiary flange 58"), and "upward" (as in "retracting upward")—are relative terms rather than absolute ones. Such terms should be regarded as words of convenience, rather than limiting terms.

Various preferred versions of the invention are shown and described above to illustrate different possible features of the invention and the varying ways in which these features may be combined. Apart from combining and connecting the different features of the foregoing versions in varying ways, other modifications are also considered to be within the scope of the invention. Following is an exemplary list of such modifications.

For example, the tertiary flange 58 need not extend from the L-shaped bracket base 62. Instead, the U-shaped bracket base 60 may elongated so that the tertiary flange 58 could extend directly from the elongated U-shaped bracket base 60 without the need for the L-shaped bracket portion 52. However, the exemplary L-shaped bracket portion 52 discussed above may be used to strengthen the locking hinge mechanism 12 by reinforcing the frame bracket 1.

Also, actuation of the hinge mechanism 12 is not limited to a configuration that uses the button 6 and spring 10 but rather can be actuated via other mechanisms that push the actuation rod 4. The hinge mechanism 12 can, for example, be actuated using pneumatic cylinders and/or hydraulic pistons. The actuation rod 4 could (for example) be a pneumatic cylinder shaft or hydraulic piston shaft.

Additionally, the tertiary flange 58 can be modified to serve as a barrier to the descending lock plate 5 when the button 6 is pressed. That is, if the tertiary flange aperture 104 is eliminated from the tertiary flange 58, the lock plate 5 would not be able to descend if the lock plate base 120 comes in contact with the modified tertiary flange. This could be used as a mechanism to prevent the locking flange 122 from retracting from the locking aperture 124 if the height of the lock plate 5 is at least as great as the distance between the secondary flange 56 and the modified tertiary flange.

Moreover, FIG. 3D shows the locking flange 122 inserted into the barrel locking groove 118. Although the locking flange 122 is shown having an approximately rectangular shape while the barrel locking groove 118 is shown having a rounded interior, the two can be modified to have complementarily interfittable shapes (by, for example, providing the locking flange 122 with a rounded end).

Further, the upper and lower barrel mounting apertures 112, 114 need not extend the entire width of the cylindrical barrel 2 between opposing sides thereof. The barrel mounting apertures 112, 114 may instead extend through the barrel 2 at any suitable angle and to any suitable degree to support fasteners therein.

Furthermore, although the hardware assembly in the figures is appropriate for modular seat backs of wheelchairs, the hinge mechanism 12 can be secured to any structure or device having any configuration. To engage other types of wheelchairs, for example, the interface bracket 25 can be modified to accommodate flat seat backs by making the interface bracket rear and front flanges 25A, 25C substantially parallel with each other (that is, making the interface bracket base 25B perpendicular to both the interface bracket rear and front flanges 25A, 25C). Alternatively or additionally, the interface bracket 25 can be split into two or more parts having, for example, two L-shaped interface bracket portions (with optional apertures formed therein), the L-shaped interface bracket portions securable to each other in various configurations to accommodate seat backs with different dimensions (using, for example, fasteners extending through one of several selectable apertures formed in the interface bracket portions). For a flat seat back, the L-shaped interface brackets could be secured to each other to provide rear and front flanges that are parallel with each other (and perpendicular to a bracket base). The rear and front flanges could be positioned at the rear and front of a flat seat back, respectively, when secured to a flat seat back.

It should be understood that the versions of the invention described above are merely exemplary, and the invention is not intended to be limited to these versions. Rather, the scope of rights to the invention is limited only by the claims set out below, and the invention encompasses all different versions that fall literally or equivalently within the scope of these claims.

What is claimed is:

1. A hinge mechanism having:

a. a frame bracket including a primary flange and a secondary flange, the primary and secondary flanges extending from a frame bracket base,
   i. the primary flange having a primary flange aperture formed therein,
   ii. the secondary flange having a secondary flange aperture and a locking aperture formed therein;

b. a barrel extending from a barrel first end to a barrel second end along a length, the barrel:
   i. being positioned between the primary and secondary flanges;
   ii. including a barrel locking groove formed at the barrel second end; and
   iii. a barrel channel;

c. an actuation rod extending through the barrel channel from the primary flange aperture to the secondary flange aperture; and d. a lock plate having a locking flange sized to be receivable through the locking aperture and within the barrel locking groove, wherein the hinge mechanism is configured to be switchable between:
   i. a rotatable state in which the locking flange is not positioned in the barrel locking groove and the barrel is rotatable about a barrel long axis; and
   ii. a locked state in which the locking flange is positioned through the locking aperture and in the barrel locking groove and the barrel is not rotatable about the barrel long axis, wherein the locking flange is incapable of extending the entire length of the barrel in the locked state such that the locking flange does not extend all the way to the barrel first end in the locked state.

2. The hinge mechanism of claim 1 wherein the locking flange is spring-biased toward the barrel locking groove.

3. The hinge mechanism of claim 1 wherein:

a. the secondary flange aperture is distinct and offset from the locking aperture; and b. in the rotatable state, the locking flange extends at least partly into the locking aperture.

4. The hinge mechanism of claim 1 wherein the locking flange is configured to be complementary to the barrel locking groove such that the locking flange fits snugly within the barrel locking groove.

5. The hinge mechanism of claim 1 in combination with:

a. a pad bracket extending from the barrel, the pad bracket having a support pad secured thereto; and b. a hardware assembly having an interface bracket secured to the frame bracket base, the hardware assembly being configured to secure the support pad to a seat back.

6. The hinge mechanism of claim 1 wherein:

a. the barrel channel extends along the barrel long axis from the barrel first end to the barrel second end; and b. the barrel channel is aligned with the primary and secondary flange apertures.

7. The hinge mechanism of claim 6 wherein the actuation rod has an actuation rod first end and an opposing actuation rod second end, wherein the lock plate is secured to the actuation rod second end.

8. The hinge mechanism of claim 7 wherein the lock plate further includes a lock plate base from which the locking flange extends, the lock plate being:

a. secured to the actuation rod second end; and b. positioned below the secondary flange.

9. The hinge mechanism of claim 8 further including:

a. a button secured to the actuation rod first end, the button being positioned above the primary flange; and b. a compression spring extending between the button and the primary flange, the compression spring being configured to upwardly bias the button away from the primary flange.

10. The hinge mechanism of claim 9 further including a first rod fastener and a second rod fastener, wherein:

a. the button includes a button aperture extending therethrough;

b. the lock plate base includes a lock plate base aperture extending therethrough;

c. the actuation rod includes internal threading at the actuation rod first and second ends;

d. the first rod fastener extends through the button aperture and engages the internal threading at the actuation rod first end to secure the button to the actuation rod; and e. the second rod fastener extends through the lock plate base aperture and engages the internal threading at the actuation rod second end to secure the lock plate to the actuation rod.

11. The hinge mechanism of claim 10 further including a tertiary flange extending from the frame bracket base, wherein:

a. the lock plate descends toward the tertiary flange when the button is pressed;

b. the tertiary flange is distanced from the secondary flange such that when the button is pressed downwardly the locking flange is permitted to exit the barrel locking groove.

12. The hinge mechanism of claim 11 further including a cover, the cover extending over the tertiary flange to cover the space between the secondary and tertiary flanges.

13. The hinge mechanism device of claim 11 wherein:

a. the frame bracket includes:

i. a U-shaped bracket portion having a U-shaped bracket base from which the primary and secondary flanges extend; and ii. an L-shaped bracket portion having an L-shaped bracket base from which the tertiary flange extends; and b. the U-shaped bracket base is secured to the L-shaped bracket base, the U-shaped bracket base and the L-shaped bracket base forming the frame bracket base.

14. The hinge mechanism of claim 9 further including a rod fastener, wherein:

a. the lock plate base includes a lock plate base aperture extending therethrough; and b. the rod fastener extends through the lock plate base aperture to secure the lock plate to the actuation rod.

15. A hinge mechanism having:

a. a frame bracket including a primary flange and a secondary flange, the primary and secondary flanges extending from a frame bracket base, wherein:

i. the primary and secondary flanges form a primary valley therebetween; and ii. the secondary flange has a locking aperture formed therein;

b. a barrel positioned within the primary valley, the barrel including a barrel locking groove formed therein;

c. an actuation rod extending through a barrel channel of the barrel from the primary flange to the secondary flange;

d. a lock plate including a locking flange extending from a lock plate base, wherein:

i. the locking flange is configured to be receivable through the locking aperture and into the barrel locking groove; and ii. the lock plate is transposable into a position in which the locking flange enters the barrel locking groove to prevent the barrel from rotating about a barrel long axis, wherein the locking flange is incapable of extending an entire length of the barrel when the locking flange enters the barrel locking groove.

16. The hinge mechanism of claim 15 further including a compression ring configured to spring-bias the locking flange toward the barrel locking groove, wherein the barrel is rotatable about the barrel long axis when the locking flange is retracted from the barrel locking groove.

17. The hinge mechanism of claim 15 further including a tertiary flange extending from the frame bracket base, the secondary and tertiary flanges forming a secondary valley therebetween, wherein:

a. the lock plate base is positioned within the secondary valley; and b. the locking flange is positioned at least partly within the locking aperture.

18. The hinge mechanism of claim 15 further including an actuation rod, wherein:

a. the barrel channel extends along the barrel long axis; and b. the lock plate is secured to the actuation rod such that the lock plate and actuation rod move axially together.

19. A hinge mechanism having:

a. a frame bracket including a primary flange and a secondary flange extending from a frame bracket base, i. the primary flange having a primary flange aperture formed therein, ii. the secondary flange having a secondary flange aperture and a locking aperture formed therein;

b. a barrel extending from a barrel first end to a barrel second end along a length, the barrel:

i. being positioned between the primary and secondary flanges; and ii. including:

1) a barrel channel extending along a long axis of the barrel; and 2) a barrel locking groove formed in the barrel at the barrel second end;

c. an actuation rod extending through the barrel channel from the primary flange aperture to the secondary flange aperture, the actuation rod:

i. having an actuation rod first end and an actuation rod second end; and ii. being spring-biased in an upwardly direction away from the secondary flange and toward the primary flange;

d. a lock plate secured to the actuation rod second end, the lock plate having a locking flange extending from a lock plate base, wherein:

i. the lock plate base is positioned below the secondary flange, with the locking flange receivable through the locking aperture of the secondary flange; and ii. the locking flange is configured to enter the barrel locking groove to prohibit the barrel from rotating about the barrel long axis when the locking aperture overlaps the barrel locking groove, wherein the locking flange is incapable of extending the entire length of the barrel when in the barrel locking groove such that the locking flange does not extend all the way to the barrel first end when in the barrel locking groove.

20. The hinge mechanism of claim 19 further including a tertiary flange extending from the frame bracket base, wherein:

a. the lock plate base is positioned between the secondary and tertiary flanges; and b. the secondary and tertiary flanges are separated from each other such that the locking flange is retractable from the barrel locking groove.

21. The hinge mechanism of claim 19 further including:

a. a button secured to the actuation rod first end; and b. a compression spring extending between the button and the primary flange, wherein the hinge mechanism is configured such that exerting downward force on the button results in the locking flange being retracted from the barrel locking groove.

22. The hinge mechanism of claim 19 a. in combination with:

i. a pad bracket configured to be securable to a support pad; and ii. a hardware assembly having an interface bracket, the hardware assembly being configured to secure the hinge mechanism to a wheelchair seat back;

b. wherein:

i. a pair of barrel mounting apertures is formed in the barrel, the pad bracket being secured to the barrel via the barrel mounting apertures; and ii. a pair of bracket base apertures is formed in the frame bracket base, the interface bracket being secured to the frame bracket via the bracket base apertures.

* * * * *